United States Patent [19]

Otsuka et al.

[11] 4,413,410

[45] Nov. 8, 1983

[54] ELECTRIC SHAVER WITH ROTARY BLADE

[75] Inventors: Kiyotaka Otsuka; Masao Tanahashi, both of Hikone, Japan

[73] Assignee: Matsushita Electric Works, Ltd., Osaka, Japan

[21] Appl. No.: 321,749

[22] Filed: Nov. 16, 1981

[30] Foreign Application Priority Data

Nov. 29, 1980 [JP] Japan ..... 55-168833

[51] Int. Cl.[3] ..... B26B 19/14

[52] U.S. Cl. ..... 30/43.6; 30/346.5

[58] Field of Search ..... 30/43.6, 43.5, 43.4, 30/43.1, 42, 49, DIG. 2, 346.5, 346.51

[56] References Cited

U.S. PATENT DOCUMENTS

| | | | |
|---|---|---|---|
| 3,552,007 | 7/1968 | Yamada | 30/34.1 |
| 3,858,316 | 1/1975 | Tietjens | 30/43.6 |

FOREIGN PATENT DOCUMENTS

| | | | |
|---|---|---|---|
| 52-72669 | 6/1977 | Japan | 30/43.6 |
| 54-115955 | 9/1979 | Japan | 30/43.5 |
| 54-133947 | 10/1979 | Japan | 30/43.6 |
| 183621 | 8/1966 | U.S.S.R. | 30/43.6 |

*Primary Examiner*—E. R. Kazenske
*Assistant Examiner*—Douglas D. Watts
*Attorney, Agent, or Firm*—Stevens, Davis, Miller & Mosher

[57] ABSTRACT

A rotary type electric shaver, having an inner cutter and a shaving head mounted thereover; the inner cutter including a rotatable base having receiving slits radially about its axis of rotation; the inner cutter also including a cutter blade inserted in each receiving slit, each cutter blade having a cutting edge and a leg portion, the leg portion terminating in a distal edge having at least one receiving notch and a receiving hole, the receiving hole being located closer to the axis of rotation of rotatable base than that receiving notch; the inner cutter also including a spring assembly for each receiving slit, each spring assembly having at least two spring portions, one end of each spring portion being fixed to the lower surface of the rotatable base, the other end of one of the spring portions engaging the receiving hole and exerting a downward force thereon, the end of the other spring portion engaging the receiving notch and exerting an upward force thereon; the shaving head including a thin, perforated comb; the cutting edge of each cutter blade bearing against the lower surface of the comb; the net upward force on the receiving notch being such that a uniform contact pressure between the cutting edge of each cutter blade against the lower surface of the comb is maintained along the entire cutting edge during operation of the shaver.

6 Claims, 12 Drawing Figures

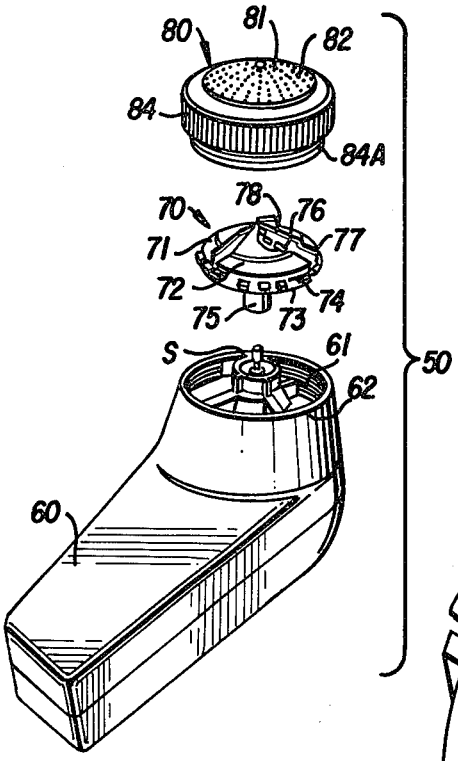
FIG. 3
FIG. 5
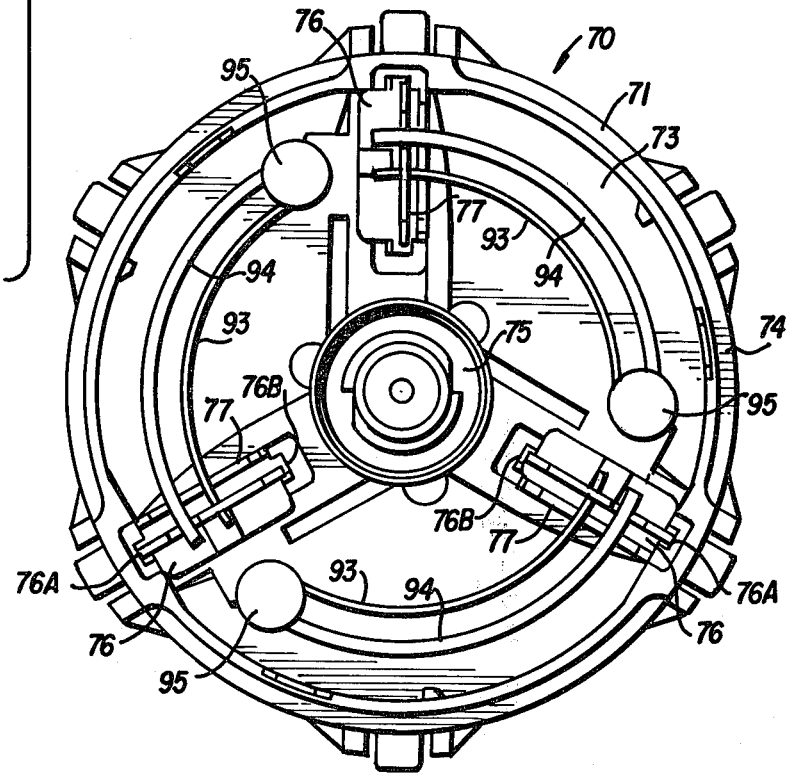
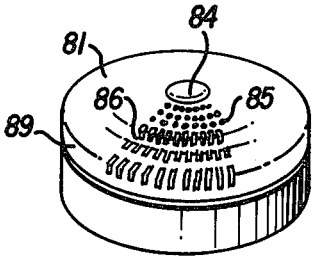
FIG. 6
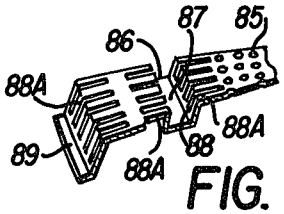
FIG. 7

ELECTRIC SHAVER WITH ROTARY BLADE

BACKGROUND OF THE INVENTION

The present invention relates to improvements in dry shavers, particularly rotary type dry shavers. More particularly, the present invention relates to improvements in the shaving unit of rotary type dry shavers. Rotary type dry shavers are shavers in which the shaving unit comprises a shaving head (sometimes referred to as an outer cutter blade body) and an inner cutter (sometimes referred to as an inner cutter blade body) over which the shaving head is mounted. Typically, the shaving head includes a thin, perforated metal plate referred to as a comb (or outer cutter blade) which is pressed against the skin during operation of the shaver, the perforations permitting whiskers and hair to pass through the comb. The inner cutter includes a rotatable base (sometimes referred to as an inner cutter blade base) on which cutter blades (sometimes referred to as inner cutter blades) are mounted radially about the axis of rotation of the base. The cutting edges of these cutter blades are in contact or nearly in contact with the perforated metal comb over substantially their entire length. (The inner cutter blades are thus substantially perpendicular to the inner surface of the comb.) On rotation of the base, the cutter blades rotate past the perforations of the comb and cut any hair or whiskers which has passed those perforations. Typically, the rotatable base is rotated by means of an electric motor, and hence these shavers are often referred to as rotary type electric shavers. An example of a rotary type electric shaver is described in U.S. Pat. No. 3,552,007, issued to Yamada on Jan. 5, 1971, which is hereby incorporated by reference.

Conventional rotary type electric shavers suffer from certain disadvantages relating to the means by which the cutter blades are mounted on the rotatable base. In the conventional mounting, each cutter blade possesses a leg portion which extends away from its cutting edge to what may be called the distal edge of the cutter blade. This distal edge possesses a receiving hole formed from an extension of the center of the distal edge. The leg portion of each cutter blade is inserted through a receiving slit in the rotatable base where it is engaged by a leaf spring mounted on the bottom of the rotatable base, the leaf spring being divided into subleaves which resiliently engage the distal edge of the cutter blade including the receiving hole. There is one receiving slit and one associated leaf spring for each cutter blade. Typically, the leaf springs engage their respective cutter blades below the center of gravity of those blades. So mounted, each cutter blade has some freedom of movement in all directions.

Because of this method of mounting, when the shaver is in use, each cutter blade possesses a moment of rotation about an axis passing through its center of gravity and perpendicular to its surface which may be referred to as the cutter blade rotational axis. This axis is perpendicular to the axis of rotation of the rotatable base on which the cutter blade is mounted. The tendency of the cutter blade to rotate about its own rotational axis results in nonuniform contact pressure between the cutting edge of the cutter blade and the comb, resulting in reduced cutting efficiency, uneven wear of the cutting edge of the cutter blade and even breakage of the cutter blade.

SUMMARY OF THE INVENTION

The claimed invention overcomes the disadvantages described above by providing a mounting for cutter blades on the rotatable base which includes means for compensating for the moment of rotation possessed by the cutter blades when the shaver is in operation.

BRIEF DESCRIPTION OF THE DRAWINGS

FIG. 3 is an exploded, perspective view of a rotary type electric shaver employing the improved shaving unit of the claimed invention.

FIG. 5 is a bottom plan view of the shaving unit of FIG. 4.

FIG. 6 is a perspective view of the thin, perforated metal comb employed in the claimed invention.

FIG. 7 is a detail of the perforations of the comb of FIG. 6.

DETAILED DESCRIPTION OF THE INVENTION

Figure 1:
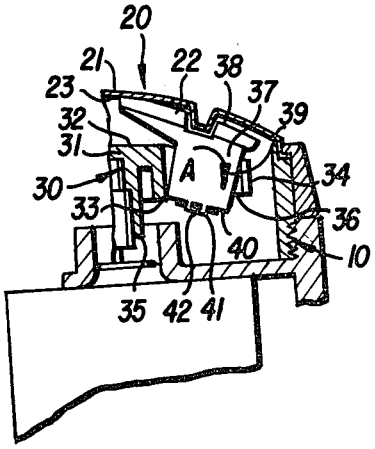
FIG. 1 (PRIOR ART)
FIG. 1 is a fragmentary cross-section view of a conventional shaving unit detailing the conventional means for mounting the cutter blades.
Figure 2:
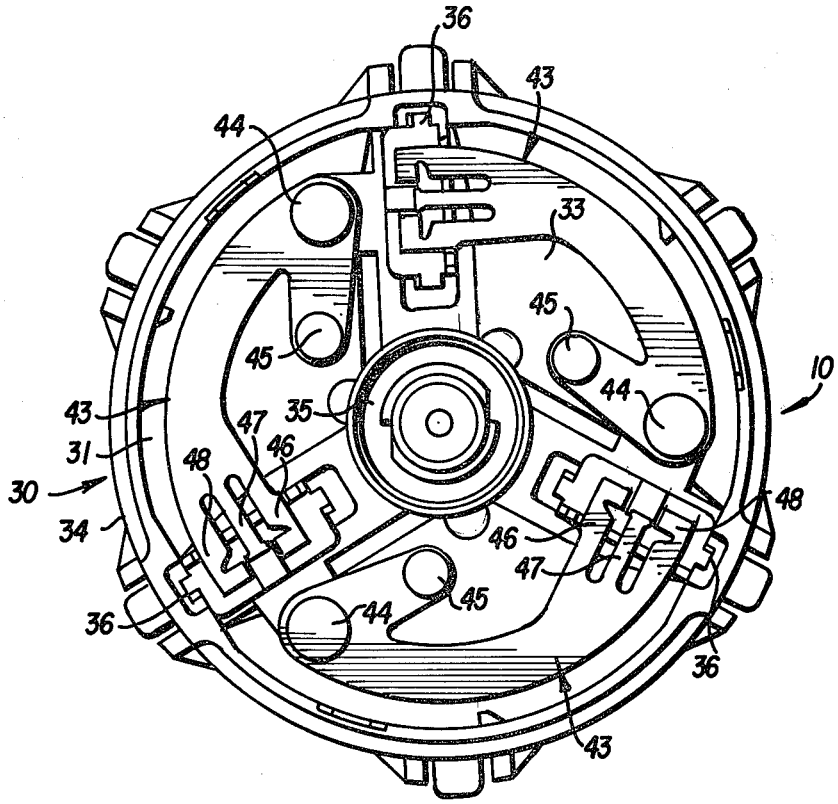
FIG. 2 (PRIOR ART)
FIG. 2 is a bottom plan view of the conventional shaving unit of FIG. 1, detailing the bottom of the inner cutter and showing the conventional leaf springs mounted on the bottom of the rotatable base.

Referring now to FIGS. 1 and 2, these, as mentioned, illustrate the shaving unit of a conventional rotary type electric shaver. The shaving unit 10 is comprised of a shaving head 20 and an inner cutter 30. The inner cutter 30 is seen to include a rotatable base 31 having an upper surface 32 and a lower surface 33 joined by peripheral edge 34. The central portion of lower surface 33 is formed into a cup 35 adapted to receive a rotatable shaft which is connected to and driven by an electric motor. Rotatable base 31 also has blade receiving slits 36 which are arranged radially about its axis of rotation. Inserted in each receiving slit 36 is a cutter blade 37, sometimes referred to as an inner cutter blade. Each cutter blade 37 includes a cutting edge 38 and a leg portion 39 extending away from cutting edge 38 and terminating in distal edge 40. At the center of distal edge 40, there is an extension portion 41 which includes a receiving hole 42. It is the leg portion 39 of cutter blade 37 which is inserted into blade receiving slit 36.

Attached to the lower surface 33 of rotatable base 31 are leaf springs 43, there being one leaf spring 43 for each blade receiving slit 36 (and thus for each cutter blade 37). One end of each leaf spring 43 is fixed to the lower surface 33 of rotatable base 31, for example, by major mounting pin 44 and minor mounting pin 45. As shown in FIG. 2, the free end of each leaf spring 43 is divided into three spring leaf portions which may conveniently be referred to as sub-leaves: a first or inner sub-leaf 46, a second or central sub-leaf 47 and a third or outer sub-leaf 48. Central sub-leaf 47 engages receiving hole 42. Inner sub-leaf 46 engages distal edge 40 between extension portion 41 and the axis of rotation of rotatable base 31. Outer sub-leaf 48 engages distal edge 40 between extension portion 41 and peripheral edge 34. Both inner sub-leaf 46 and outer sub-leaf 48 exert an upward force (a force in the direction from lower surface 33 to upper surface 32 of rotatable base 31) against distal edge 40 and thus against cutter blade 37. On the other hand, central sub-leaf 47 exerts a downward force (a force in the direction from upper surface 32 to lower surface 33 of inner cutter blade base 31) against receiving hole 42 and thus against cutter blade 37.

Mounted over inner cutter 30 is shaving head 20 which includes a thin, perforated comb 21 having an upper surface 22 and a lower surface 23. As mounted, lower surface 23 of comb 21 faces upper surface 32 of rotatable base 31 and the action of sub-leaves 46, 47 and 48 is such as to cause the cutting edge 38 of each cutter blade 37 to bear or nearly bear against the lower surface 23 of comb 21.

When the shaver is in use, comb 21 is pressed against the face and the rotatable base 31 (and thus cutter blades 37) are rotated about the axis of rotation of rotatable base 31. The rotating cutter blades 37 then cut off any whiskers or hair passing through the perforations of comb 21.

Conventionally, the upward forces exerted by inner sub-leaf 46 and outer sub-leaf 48 are approximately equal. Because of this, the contact pressure between the cutting edge 38 of each cutter blade 37 and the inner surface 23 of comb 21 is substantially uniform along the entire length of cutting edge 38. This is true, however, only when cutter blades 37 are not rotating, that is only when the shaver is not in use. When the shaver is in use, the distribution of contact pressure is different because the cutter blade 37 is supported (by sub-leaves 46, 47 and 48) below its center of gravity A. Thus, when the shaver is in use and the cutter blades 37 are rotated about the axis of rotation of rotatable base 31, the centrifugal force generated by such rotation causes each cutter blade 37 to have a moment of rotation (see arrow in FIG. 1) about an axis perpendicular to its surface and passing through its center of gravity A (and also perpendicular to the axis of rotation of rotatable base 31). This results in that portion of cutting edge 38 of each cutter blade 37 between center of gravity A and the axis of rotation of rotatable base 31 having an increased force of contact with the lower surface 23 of comb 21, thus increasing wear and the possibility of breakage along that portion of cutting edge 38. Correspondingly, the portion of cutting edge 38 extending from center of gravity A toward peripheral edge 34 will have a decreased force of contact with the lower surface 23 of comb 21 resulting in decreased cutting efficiency along that portion.

The claimed invention has as its purpose the avoidance of the above-described disadvantages of conventional rotary type electric shavers by providing means for establishing and maintaining substantially uniform contact pressure between the cutting edge of the cutter blades and the inner surface of the perforated comb along the entire length of the cutting edge of the cutter blades during use of the shaver.

FIG. 3 illustrates a rotary type electric shaver 50 embodying the claimed invention. As depicted in FIG. 3, it includes a main body 60, an inner cutter 70 and a shaving head 80. Inner cutter 70 and shaving head 80 are the components of the shaving unit of shaver 50.

The inner cutter 70 is seen to include a rotatable base 71 having an upper surface 72 and a lower surface 73 which are joined by peripheral edge 74. The central portion of lower surface 73 is formed into a cup 75 adapted to receive a shaft S which is connected to and driven by an electric motor housed in main body 60. Rotatable base 71 also has blade receiving slits 76 which are arranged radially about its axis of rotation. These blade receiving slits may themselves each be formed as downward extensions of associated larger but shallower depressions or grooves disposed radially on the upper surface 72 of rotatable base 71, there being one such depression or groove for each receiving slit 76. Inserted in each blade receiving slit 76 is a cutter blade 77, sometimes referred to as an inner cutter blade. Each cutter blade 77 includes a cutting edge 78 and a leg portion 79 (not shown in FIG. 3) extending away from cutting edge 78 and terminating in distal edge 79A (not shown in FIG. 3). It is the leg portion 79 of cutter blade 77 which is inserted in blade receiving slit 76. Attached to the lower surface 73 of inner cutter blade base 71 are leaf spring assemblies (not shown in FIG. 3), there being one leaf spring assembly for each blade receiving slit 76 (and thus for each cutter blade 77). Each leaf spring assembly is fixed to the lower surface 73 of inner cutter blade base 71 by, for example, mounting pins (not shown in FIG. 3). Each leaf spring assembly engages the distal edge 79A of its respective cutter blade 77 to resiliently support that blade in its blade receiving slit 76.

Mounted over inner cutter 70 is shaving head 80 which includes a thin, perforated metal comb 81 having an upper surface 82 and a lower surface 83. Lower surface 83 of comb 81 faces upper surface 72 of rotatable base 71 and the action of the leaf spring assembly referred to is to cause the cutting edge 78 of each cutter blade 77 to bear or nearly bear against lower surface 83 of comb 81 when mounting of the shaving head 80 is effected. Mounting of the shaving head 80 is effected in the particular case illustrated by carrying comb 81 on a comb base 84 having exterior threads 84A which engage interior threads 61 of wall portion 62 of main body 60.

When the shaver 50 is in use, comb 81 is pressed against the face and the rotatable base 71 (and thus cutter blades 77) are rotated about the axis of rotation of rotatable base 71. The rotating cutter blades 77 then cut off any whiskers or hair passing through the perforations of comb 81.

Figure 4:
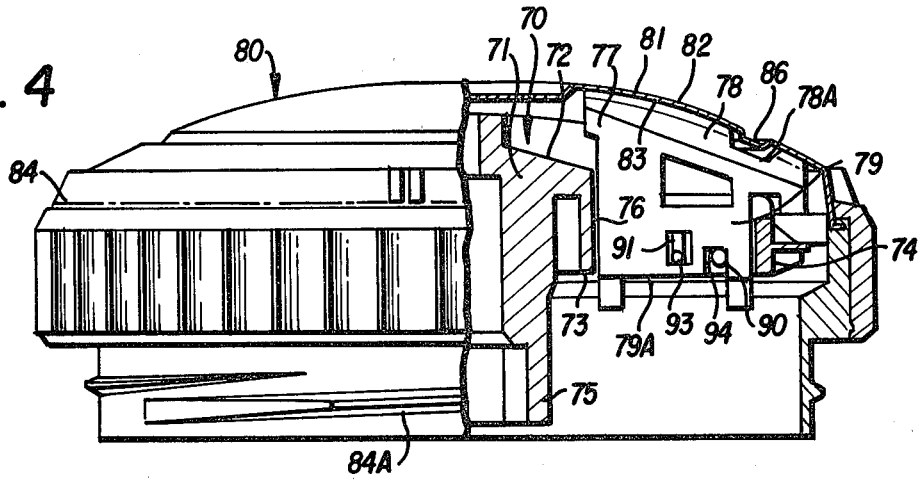
FIG. 4 is a side elevation, partially in section, of a shaving unit employing one embodiment of the claimed invention.

Of particular importance to the claimed invention is the spring assembly which engages and resiliently holds the cutter blades 77 in the rotatable base 71. FIGS. 4 and 5 illustrate one embodiment of this aspect of the claimed invention. In FIGS. 4 and 5 rotatable base 71 is made of a synthetic resin and blade receiving slits 76 are rectangular in shape. The cutter blades 77 have a leg portion 79 extending away from cutting edge 78 and terminating in a distal edge 79A. On distal edge 79A is a receiving notch 90. Between receiving notch 90 and the axis of rotation of the rotatable base 71, distal edge 79A also has a receiving hole 91. It is leg portion 79 which is inserted in blade receiving slit 76. Each blade receiving slit 76 may have a pair of guide grooves 76A and 76B, one guide groove at each of its two narrow ends. The leg portion 79 of cutter blade 77, when inserted into the blade receiving slit 76 may then fit into these guide grooves 76A and 76B. The cutter blades 77, however, retain some freedom of movement, particularly in the up and down direction.

Attached to the lower surface 73 of rotatable base 71 are pairs of wire springs, one pair of wire springs for each cutter blade 77. Each pair of wire springs is comprised of a first or inside wire spring 93 and a second or outside wire spring 94 of approximately comparable length, the diameter of the wire of inside wire spring 93 being less than the diameter of outside wire spring 94. One end of each of wire spring 93 and 94 is secured to the lower surface 73 of rotatable base 71 by, for example, a mounting pin 95. The free end of inside wire spring 93 engages receiving hole 91 of distal edge 79A and exerts a downward force upon it (that is, a force in the direction from the upper surface 72 to the lower surface 73 of rotatable base 71) and thus exerts a downward force on cutter blade 77. The free end of outer wire spring 94 engages receiving notch 90 of distal edge 79A and exerts an upward force upon it (that is, a force in the direction from the lower surface 73 to the upper surface 72 of inner cutter blade base 71) and thus exerts an upward force on cutter blade 77. The outside wire spring 94, is of larger diameter than inside wire spring 93, and exerts a greater force in the upward direction than inside wire spring 93 does in the downward direction and thus opposes and compensates for the rotational moment of cutter blade 77 about its own cutter blade rotational axis when the shaver is in use. The compensatory force results in the contact pressure between the cutting edge 78 of cutter blade 77 and the inner surface 83 of comb 81 to be substantially uniform along the entire length of cutting edge 78 of cutter blade 77 when the shaver is in operation. This results in greater cutting efficiency, less wear on the cutting edge 78 of the cutter blade 77 and less likelihood of breakage of cutter blade 77.

FIGS. 6 and 7 illustrate a preferred comb 81 for use in the claimed invention. The comb 81 is of thin metal and has a shape corresponding to a section of a hollow sphere having a center 84 and a periphery 89. Near center 84 are circular perforations 85 and beyond these a concentric groove 86 having a bottom 87 and sidewalls 88. Sidewalls 88 bear slit perforations 88A as does the periphery 89. Where comb 81 is employed, cutting edge 78 possesses a notch 78A complementary to concentric groove 86.

Figure 8:
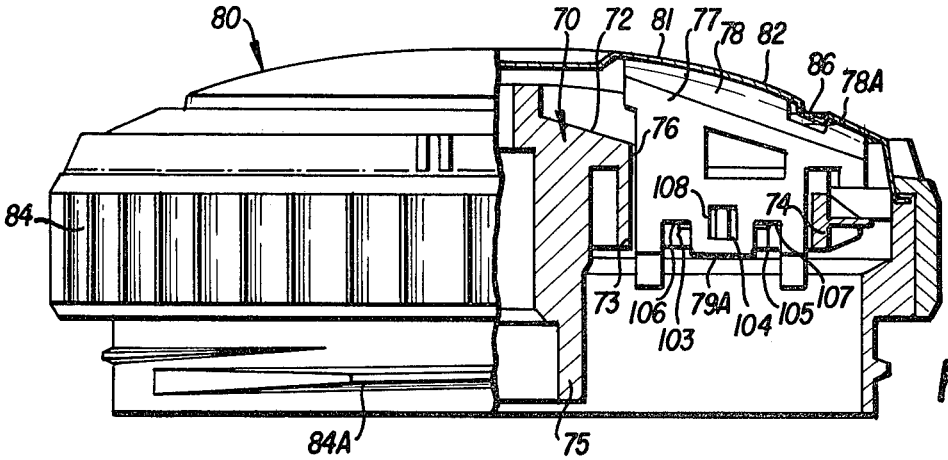
FIG. 8 is a side elevation, partially in section, of a shaving unit employing a second embodiment of the claimed invention.
Figure 9:
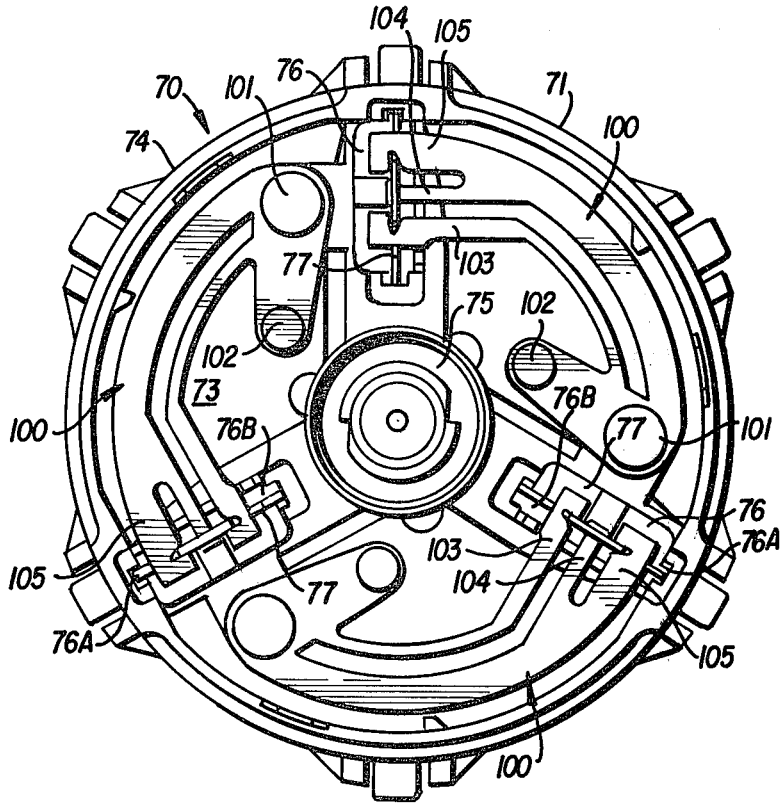
FIG. 9 is a bottom plan view of the shaving unit of FIG. 8.

FIGS. 8 and 9 illustrate a variation of the compensating spring force means of the claimed invention. In that embodiment a leaf spring 100 is employed, one leaf spring 100 for every cutter blade 77. Each leaf spring 100 is attached to the lower surface 73 of rotatable base 71 by, for example, a major mounting pin 101 and a minor mounting pin 102. The free end of each leaf spring 100 is divided into three leaf spring portions or sub-leaves: a first or inner sub-leaf 103, a second or central sub-leaf 104 and a third or outer sub-leaf 105. Inner sub-leaf 103 is relatively narrow while outer sub-leaf 105 is relatively wide. In this embodiment, distal edge 79A of the cutter blade 77 carries two receiving notches: first or inner receiving notch 106 and second or outer receiving notch 107. Between inner receiving notch 106 and outer receiving notch 107, distal edge 79A has a receiving hole 108. Inner sub-leaf 103 engages inner notch 106 on distal edge 79A and presses it and thus cutter blade 77 in an upward direction. Outer sub-leaf 105 engages outer receiving notch 107 on distal edge 79A and also presses it and thus cutter blade 77 in an upward direction. Central sub-leaf 104 engages receiving hole 108 on distal edge 79A and presses it and thus cutter blade 77 in a downward direction. Because outer sub-leaf 105 is of approximately the same length but wider than inner sub-leaf 103, the spring force exerted by outer sub-leaf 105 on outer receiving notch 107 is greater than that exerted by inner sub-leaf 103 on inner receiving notch 106 resulting in a net compensating force tending to move the portion of cutting edge 78 nearer peripheral edge 74 upward and of course opposing and compensating for the rotational moment of cutter blade 77 about its own cutter blade rotational axis when the shaver is in use. The relative widths of sub-leaves 103, 104 and 105 are selected so that the net compensating upward force substantially balances the downward force on the portion of cutting edge 78 nearer peripheral edge 74 (and, conversely, balances the upward force at the portion of cutting edge 78 nearer the rotational axis of rotatable base 71) when the shaver is in use. This results in the establishment and maintenance of a substantially uniform contact pressure between cutting edge 78 and lower surface 83 of comb 81 along the entire length of cutting edge 78 of each cutter blade 77, resulting in greater cutting efficiency, less wear on cutting edge 78 and less likelihood of breakage of cutter blade 77. It has been determined experimentally that if the upward force exerted by outer sub-leaf 105 is P1 and that exerted by the inner sub-leaf 103 is P2, the contact pressure will be uniform if $P1/P2 > 1.8$.

Figure 10:
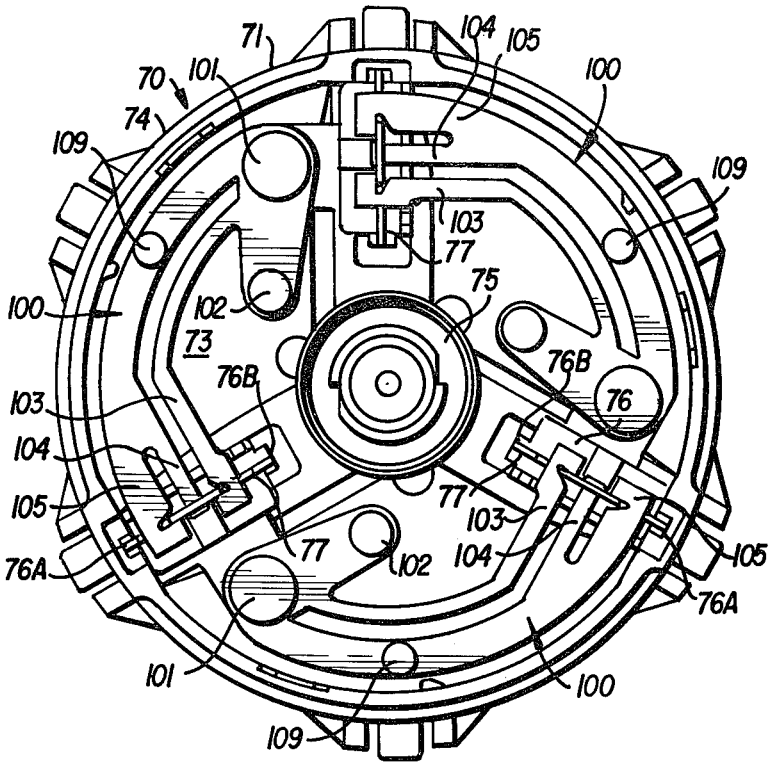
FIG. 10 is a bottom plan view of a shaving unit employing a third embodiment of the claimed invention.

In the embodiment just discussed, the spring force exerted by the inner sub-leaf 103 and outer sub-leaf 105 is varied by varying their relative widths to attain the proper ratio to ensure uniform contact pressure. However, as illustrated in FIG. 10 the same effect may be attained or augmented by varying the point of support or affixation of the leaf spring 100 or its sub-leaves 103, 104 and 105. Thus as shown in FIG. 10, an additional mounting pin 109 fixes that portion of leaf spring 100 which is ultimately divided to form sub-leaves 104 and 105 at a point between major mounting pin 101 and the free end of that portion as originally envisaged in FIGS. 8 and 9. The effect of shortening the length of that portion of spring 100 is to shorten the length of outer sub-leaf 105, increasing its upward force.

Figure 11:
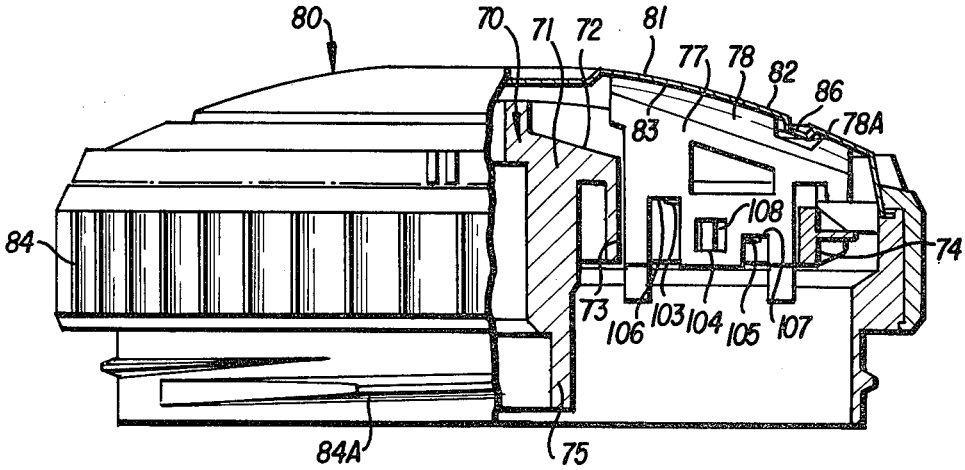
FIG. 11 is a side elevation, partially in section, of a shaving unit employing a fourth embodiment of the claimed invention.

Another possibility, shown in FIG. 11, is to increase the depth of inner receiving notch 106 relative to outer receiving notch 107, which would also have the effect of increasing the upward force of outer sub-leaf 105 relative to inner sub-leaf 103.

Figure 12:
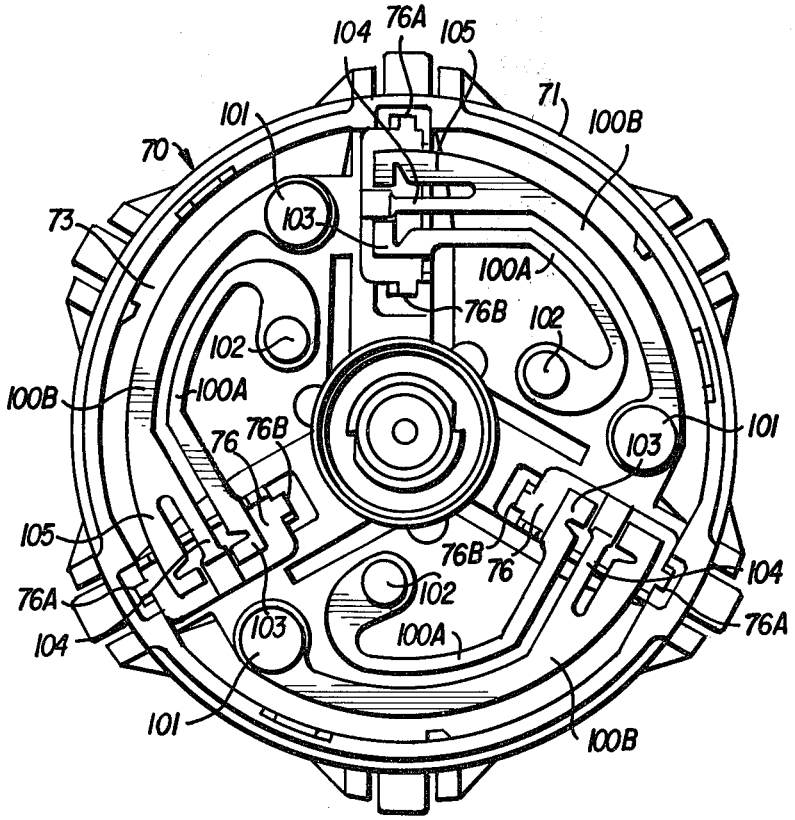
FIG. 12 is a bottom plan view of a shaving unit employing a fifth embodiment of the claimed invention.

Of course, any combination of the foregoing could also be employed to generate the necessary compensating force. In addition, as shown in FIG. 12, it is also possible to generate the compensating force by separating spring leaf 100 into two components: a first or inner component 100A and a second or outer component 100B, the latter being divided into central sub-leaf 104 and outer sub-leaf 105, and vary the material, width or placement of the two components independently.

What is claimed is:

1. A shaving unit for a rotary type electric shaver, comprising an inner cutter and a shaving head mounted over said inner cutter;

said inner cutter including a rotatable base having an upper surface, a lower surface, and a peripheral edge joining said surfaces, said base having receiving slits disposed radially about the axis of rotation of said rotatable base;

said inner cutter also including a cutter blade inserted in each receiving slit, each cutter blade having a cutting edge and a leg portion, said leg portion extending away from said cutting edge and terminating in a distal edge, said distal edge having a receiving notch and a receiving hole, said receiving hole being located closer to the axis of rotation of said rotatable base than said receiving notch;

said inner cutter also including a spring assembly for each said receiving slit, each spring assembly having at least first and second spring portions, one end of each spring portion being fixed to the lower surface of said rotatable base, the other end of said first spring portion engaging said receiving hole of said distal edge and exerting a downward force thereon, said second spring portion engaging said receiving notch and exerting an upward force thereon;

said shaving head including a thin, perforated comb having an upper surface and a lower surface;

said cutting edge of each cutter blade bearing against the lower surface of said comb; the thickness of said first spring portion being less than said second spring portion, the upward force of said second leaf spring portion on said receiving notch thus being greater than the downward force of said first leaf spring portion on said receiving hole;

whereby a uniform contact pressure between the cutting edge of each said cutter blade against the lower surface of said comb is maintained along the entire cutting edge when said blades are rotated with said rotatable base during operation of said shaver.

2. A shaving unit for a rotary type electric shaver, comprising an inner cutter and a shaving head mounted over said inner cutter;

said inner cutter including a rotatable base having an upper surface, a lower surface, and a peripheral edge joining said surfaces, said base having receiving slits disposed radially about the axis of rotation of said rotatable base;

said inner cutter also including a cutter blade inserted in each receiving slit, each cutter blade having a cutting edge and a leg portion, said leg portion extending away from said cutting edge and terminating in a distal edge, said distal edge having first and second receiving notches and a receiving hole, said receiving hole being located further from the axis of rotation of said rotatable base than said first receiving notch, said second receiving notch being located further from the axis of rotation of said rotatable base than said receiving hole;

said inner cutter also including a leaf spring assembly for each said receiving slit, each leaf spring assembly having at least first, second and third leaf spring portions, one end of each leaf spring portion being fixed to the lower surface of said rotatable base, the free end of said first leaf spring portion engaging said first receiving notch of said distal edge and exerting an upward force thereon, the free end of said second leaf spring portion engaging said receiving hole of said distal edge and exerting a downward force thereon; the free end of said third leaf spring portion engaging said second receiving notch of said distal edge and exerting an upward force thereon;

said shaving head including a thin, perforated comb having an upper surface and a lower surface;

said cutting edge of each cutter blade bearing against the lower surface of said comb; the width of said first leaf spring portion being less than said third leaf spring portion, the upward force of said third leaf spring portion on said second receiving notch thus being greater than the upward force of said first leaf spring portion on first receiving notch;

whereby a uniform contact pressure between the cutting edge of each said cutter blade against the lower surface of said comb is maintained along the entire cutting edge when said blades are rotated with said rotatable base during operation of said shaver.

3. A shaving unit for a rotary type electric shaver, comprising an inner cutter and a shaving head mounted over said inner cutter;

said inner cutter including a rotatable base having an upper surface, a lower surface, and a peripheral edge joining said surfaces, said base having receiving slits disposed radially about the axis of rotation of said rotatable base;

said inner cutter also including a cutter blade inserted in each receiving slit, each cutter blade having a cutting edge and a leg portion, said leg portion extending away from said cutting edge and terminating in a distal edge, said distal edge having first and second receiving notches and one receiving hole, said receiving hole being located further from the axis of rotation of said rotatable base than said first receiving notch, said second receiving notch being located further from the axis of rotation of said rotatable base than said receiving hole;

said inner cutter also including a leaf spring assembly for each said receiving slit, each leaf spring assembly having at least first, second and third leaf spring portions, one end of each leaf spring portion being fixed to the lower surface of said rotatable base, the free end said first spring leaf portion engaging said first receiving notch of said distal edge and exerting an upward force thereon, said second spring leaf portion engaging said receiving hole of said distal edge and exerting a downward force thereon; the free end of said third spring leaf portion engaging said second receiving notch of said distal edge and exerting an upward force thereon;

said shaving head including a thin, perforated comb having an upper surface and a lower surface;

said cutting edge of each cutter blade bearing against the lower surface of said comb; said third leaf spring portion being of at least the same width as said first leaf spring portion, but the length of said third spring leaf portion from its point of affixation to the lower surface of said rotatable base to its point of engagement with said second receiving notch being less than the length of said first spring leaf portion from its point of affixation to the lower surface of said rotatable base to its point of engagement with said first receiving notch so that the upward force of said third leaf spring portion on said second receiving notch is greater than the upward force of said first leaf spring portion on said first receiving notch;

whereby a uniform contact pressure between the cutting edge of each said cutter blade against the lower surface of said comb is uniform along the entire cutting edge when said blades are rotated with said rotatable base during operation of said shaver.

4. A shaving unit for a rotary type electric shaver, comprising an inner cutter and a shaving head mounted over said inner cutter;

said inner cutter including a rotatable base having an upper surface, a lower surface, and a peripheral edge joining said surfaces, said base having receiving slits disposed radially about the axis of rotation of said rotatable base;

said inner cutter also including a cutter blade inserted in each receiving slit, each cutter blade having a cutting edge and a leg portion, said leg portion extending away from said cutting edge and terminating in a distal edge, said distal edge having first and second receiving notches and a receiving hole, said receiving hole being located further from the axis of rotation of said rotatable base than said first receiving notch, said second receiving notch being located further from the axis of rotation of said rotatable base than said receiving hole;

said inner cutter also including a leaf spring assembly for each said receiving slit, each leaf spring assembly having at least first, second and third leaf spring portions, one end of each leaf spring portion being fixed to the lower surface of said rotatable base, the free end of said first leaf spring portion engaging said first receiving notch of said distal edge and exerting an upward force thereon, the free end of said second leaf spring portion engaging said receiving hole of said distal edge and extending downward force thereon; the free end of said third leaf spring portion engaging said second receiving notch at said distal edge and exerting an upward force thereon;

said shaving head including a thin, perforated comb having an upper surface and a lower surface;

said cutting edge of each cutter blade bearing against the lower surface of said comb; the depth of said first receiving notch being greater than the depth of said second receiving notch, the upward force of said third leaf spring portion on said second receiving notch thus being greater than the upward force of said first leaf spring portion on said first receiving notch;

whereby a uniform contact pressure between the cutting edge of each said cutter blade against the lower surface of said comb is maintained along the entire cutting edge when said blades are rotated with said rotatable base during operation of said shaver.

5. A shaving unit for a rotary type electric shaver, comprising an inner cutter and a shaving head mounted over said inner cutter;

said inner cutter including a rotatable base having an upper surface, a lower surface, and a peripheral edge joining said surfaces, said base having receiving slits disposed radially about the axis of rotation of said rotatable base;

said inner cutter also including a cutter blade inserted in each receiving slit, each cutter blade having a cutting edge and a leg portion, said leg portion extending away from said cutting edge and terminating in a distal edge, said distal edge having first and second receiving notches and a receiving hole, said receiving hole being located further from the axis of rotation of said rotatable base than said first receiving notch, said second receiving notch being located further from the axis of rotation of said rotatable base than said receiving hole;

said inner cutter also including a leaf spring assembly for each said receiving slit, each leaf spring assembly having at least first, second and third leaf spring portions, one end of each leaf spring portion being fixed to the lower surface of said rotatable base, the free end of said first leaf spring engaging said first receiving notch of said distal edge and exerting an upward force thereon, the free end of said second leaf spring portion engaging said receiving hole of said distal edge and exerting a downward force thereon; the free end of said third leaf spring portion engaging said second receiving notch at said distal edge and exerting an upward force thereon;

said shaving head including a thin, perforated comb having an upper surface and a lower surface;

said cutting edge of each cutter blade bearing against the lower surface of said comb; wherein said first leaf spring portion is affixed to the lower surface of said rotatable base separately from said third leaf spring portions and is made of a material of lesser spring strength than said third leaf spring portion, the difference in materials being such that the upward force of said third leaf spring portion on said second receiving notch is greater than the upward force of said first leaf spring portion on said first receiving notch;

whereby a uniform contact pressure between the cutting edge of each said cutter blade against the lower surface of said comb is maintained along the entire cutting edge when said blades are rotated with said rotatable base during operation of said shaver.

6. A shaving head as in claims 1, 2, 3, 4, or 5, wherein said upper surface of said comb includes a groove concentric with the center of said comb and wherein the cutting edge of each cutter blade includes a notch complementary with said groove.

* * * * *